US007207398B2

(12) United States Patent
Runia et al.

(10) Patent No.: US 7,207,398 B2
(45) Date of Patent: Apr. 24, 2007

(54) STEERABLE ROTARY DRILL BIT ASSEMBLY WITH PILOT BIT

(75) Inventors: Douwe Johannes Runia, Rijswijk (NL); David George Livesey Smith, Rijswijk (NL); Robert Nicholas Worrall, Rijswijk (NL)

(73) Assignee: Shell Oil Company, Houston, TX (US)

( * ) Notice: Subject to any disclaimer, the term of this patent is extended or adjusted under 35 U.S.C. 154(b) by 244 days.

(21) Appl. No.: 10/483,922

(22) PCT Filed: Jul. 16, 2002

(86) PCT No.: PCT/EP02/07958

§ 371 (c)(1),
(2), (4) Date: Jun. 28, 2004

(87) PCT Pub. No.: WO03/008754

PCT Pub. Date: Jan. 30, 2003

(65) Prior Publication Data

US 2004/0238221 A1 Dec. 2, 2004

(30) Foreign Application Priority Data

Jul. 16, 2001 (EP) ..... 01306106

(51) Int. Cl.
*E21B 7/04* (2006.01)

(52) U.S. Cl. ..... 175/61; 175/385; 175/75

(58) Field of Classification Search ..... 175/61, 175/45, 385, 386, 74, 75
See application file for complete search history.

(56) References Cited

U.S. PATENT DOCUMENTS

| | | | | |
|---|---|---|---|---|
| 2,018,007 | A * | 10/1935 | Brewster | 175/75 |
| 2,179,010 | A | 11/1939 | Creighton et al. | 255/72 |
| 2,284,580 | A | 5/1942 | Kammerer | 255/61 |
| 3,052,838 | A | 9/1962 | Bennett et al. | 324/10 |
| 3,112,442 | A | 11/1963 | Bennett | 324/1 |
| 3,429,387 | A | 2/1969 | Brown | 175/237 |
| 3,700,049 | A | 10/1972 | Tiraspolsky et al. | 175/50 |
| 4,446,935 | A * | 5/1984 | Schumacher, Jr. | 175/338 |
| 4,836,301 | A | 6/1989 | Van Dongen et al. | |

(Continued)

FOREIGN PATENT DOCUMENTS

DE 3927625 A1 8/1989

(Continued)

*Primary Examiner*—William Neuder
*Assistant Examiner*—Nicole A Coy

(57) ABSTRACT

A rotary drill bit assembly suitable for directionally drilling a borehole into an underground formation, the drill bit assembly having a bit body extending along a central longitudinal bit-body axis, and having a bit-body face at its front end, wherein an annular portion of the bit-body face is provided with one or more chip-making elements; a pilot bit extending along a central longitudinal pilot-bit axis, the pilot bit being partly arranged within the bit body and projecting out of the central portion of the bit-body face, the pilot bit having a pilot-bit face provided with one or more chip-making elements at its front end; a joint means arranged to pivotably connect the pilot bit to the bit body so that the bit-body axis and the pilot-bit axis can form a variable diversion angle; and a steering means arranged to pivot the pilot bit in order to steer the direction of drilling.

18 Claims, 1 Drawing Sheet

U.S. PATENT DOCUMENTS

| | | | | |
|---|---|---|---|---|
| 4,932,005 | A | 6/1990 | Birdwell | 367/83 |
| 4,974,688 | A | 12/1990 | Helton | 175/73 |
| 5,078,218 | A | 1/1992 | Smet | 175/45 |
| 5,103,919 | A * | 4/1992 | Warren et al. | 175/45 |
| 5,244,050 | A | 9/1993 | Estes | 173/393 |
| 5,503,236 | A | 4/1996 | Tibbitts | |
| 5,589,825 | A | 12/1996 | Pomerleau | 340/854.9 |
| 6,269,891 | B1 | 8/2001 | Runia | 175/40 |

FOREIGN PATENT DOCUMENTS

| | | |
|---|---|---|
| DE | 3927625 | 2/1991 |
| EP | 1008717 | 6/2000 |
| GB | 2146126 | 4/1985 |
| SU | 1049647 | 10/1992 |
| WO | WO017488 | 3/2000 |

* cited by examiner

STEERABLE ROTARY DRILL BIT ASSEMBLY WITH PILOT BIT

PROITITY CLAIM

The present application claims priority on European Patent Application 01306106.4 filed on 16 Jul. 2001.

FIELD OF THE INVENTION

The present invention relates to a rotary drill bit assembly, which is suitable for directionally drilling a borehole into an underground formation.

BACKGROUND OF THE INVENTION

In modern drilling operations, for example when drilling a wellbore in an oil or gas field, it is often desired to change the direction in the course of drilling. Generally one wishes to deviate the direction into which the drill bit at the lower end of a drill string progresses., away from the central longitudinal axis of the lower part of the drill string. Several drilling systems and methods have been developed for this purpose in the past.

U.S. Pat. No. 4,836,301 discloses a system and method for directional drilling. In the known system the drill bit is connected via a universal pivoting mechanism to the lower end of the drill string. The drill bit can be tilted so that the longitudinal axis of the drill bit can form a small deviation angle with the axis of the lower part of the drill string. The known system further comprises a steering means for rotating the drill bit in an orbital mode with respect to the lower part of the drill string. The steering means thereto comprises a flow deflector for providing hydrodynamical force in order to rotate the tilted drill bit azimuthally with respect to the lower part of the drill string as needed.

During normal operation of the known system, the drill string with the drill bit at its end is set to rotate, and the drill bit is tilted and counter-rotated in an orbital mode relative to the lower part of the drill string such that the axis of the drill bit remains geostationary.

The known system has the disadvantage that it requires large tilting forces on the bit, and that a complex but robust mechanism is needed for the universal pivoting mechanism in order to withstand the tilting and drilling forces at the same time.

Other systems known in the art are based on bending the lower part of the drill string above the drill bit, or on pushing the drill bit into the desired direction by applying side forces to the shaft of the drill bit.

These other systems also require complex and robust mechanisms in order to provide the large tilting forces to the bit.

SUMMARY OF THE INVENTION

It is an object of the present invention to provide an improved drill bit and drill bit assembly suitable for directional drilling of a borehole, which is mechanically simpler than the known systems.

It is a further object to provide an improved method for directional drilling of a borehole.

To this end the present invention provides a rotary drill bit assembly suitable for directionally drilling a borehole into an underground formation, the drill bit assembly comprising a bit body extending along a central, longitudinal bit-body axis, the bit body having a bit-body face at its front end and being attachable to a drill string at its opposite end, wherein an annular portion of the bit-body face is provided with one or more chip-making elements; a pilot bit extending along a central longitudinal pilot-bit axis, the pilot bit being partly arranged within the bit body and projecting out of the central portion of the bit-body face, the pilot bit having a pilot-bit face at its front end provided with one or more chip-making elements; a joint means arranged to pivotably connect the pilot bit to the bit body so that the bit-body axis and the pilot-bit axis can form a variable diversion angle; and a steering means arranged to pivot the pilot bit in order to steer, during normal operation, the direction of drilling.

The bit body, pilot bit and joint means are comprised in a drill bit according to the invention.

There is further provided a method for directional drilling of a borehole into an underground earth formation, comprising the steps of providing a rotary drill bit attached to the lower end of a drill string, the rotary drill bit comprising a bit body extending along a bit-body axis coaxial with the lower part of the drill string, and having a bit-body face at its front end, wherein an annular portion of the bit-body face is provided with one or more chip-making elements, and a pilot bit extending along a pilot-bit axis and projecting out of the central portion of the bit-body face, the pilot bit having a pilot-bit face at its front end provided with one or more chip-making elements; which pilot bit is pivotably arranged with respect to the bit body so that the bit-body axis and the pilot-bit axis can form a certain diversion angle;

setting the pilot bit along the pilot-bit axis at a selected diversion angle with respect to the bit-body axis;

providing at the same time drilling torque around the pilot-bit axis to the pilot bit and drilling torque around the bit-body axis to the bit body, and wherein the orientation of the pilot-bit axis in space is kept substantially constant during at least one revolution of the bit body about the bit-body axis.

With the pivotable pilot bit having its face some distance ahead of the face of the bit body, a tilted pilot borehole section can be drilled, wherein the depth is approximately equal to the distance between pilot-bit face and bit-body face. Due to the smaller size of the pilot bit, a smaller tilting force is needed for the pilot bit as compared to tilting the whole drill bit directly. The pilot borehole section serves as a guide for the cutting action of the bit body. The pilot bit in the pilot borehole section exerts a guiding force on the bit body, and thereby guides or levers the bit body including the attached drill string into the desired direction. The guiding force on the bit body acts near the bit-body face, thereby rather pulling than pushing the bit body into the desired direction, which is a fundamental difference to the directional drilling systems and methods known in the art.

In general, drilling torque to the pilot bit can be provided independently from the drilling torque provided from the drill string to the bit body. Suitably, the pilot bit is driven by the drilling torque provided by the drill string. In this case, if a straight borehole is to be drilled no steering is needed, and the drill bit can perform similar to a conventional rotary drill bit. The joint means can suitably be arranged so as to transmit drilling torque from the drill string, which is fixedly connected to the bit body, to the pilot bit. Preferably, the joint means torque-locks the pilot bit to the bit body, so that one revolution of the bit body about the bit-body axis results in one revolution of the pilot bit about the pilot-bit axis. It will be understood, however, that a gearing mechanism can be arranged so that the pilot bit rotates with a different angular speed than the bit body. The pilot bit can also be driven from a different source not directly coupled to the rotary action of the drill string, such as a mud motor.

In the case that the pilot bit and bit body are rotated together, each about its respective longitudinal axis, the pilot bit is suitably pivoted such that the pilot-bit axis performs an orbital motion with respect to the bit-body axis, in opposite direction and with the same angular velocity of the rotation of the bit body. In this way the pilot-bit axis can be kept substantially stationary in space, with respect to the non-rotating environment. In order to allow the orbital motion the joint means is a spherical joint means, which allows the pilot bit to rotate azimuthally about the bit-body axis while the pilot-bit axis is pivoted at a non-zero diversion angle.

BRIEF DESCRIPTION OF THE DRAWINGS

The FIGURE shows schematically an example of a rotary drill bit assembly 1 for directionally drilling a borehole into an underground formation.

Figure 1:
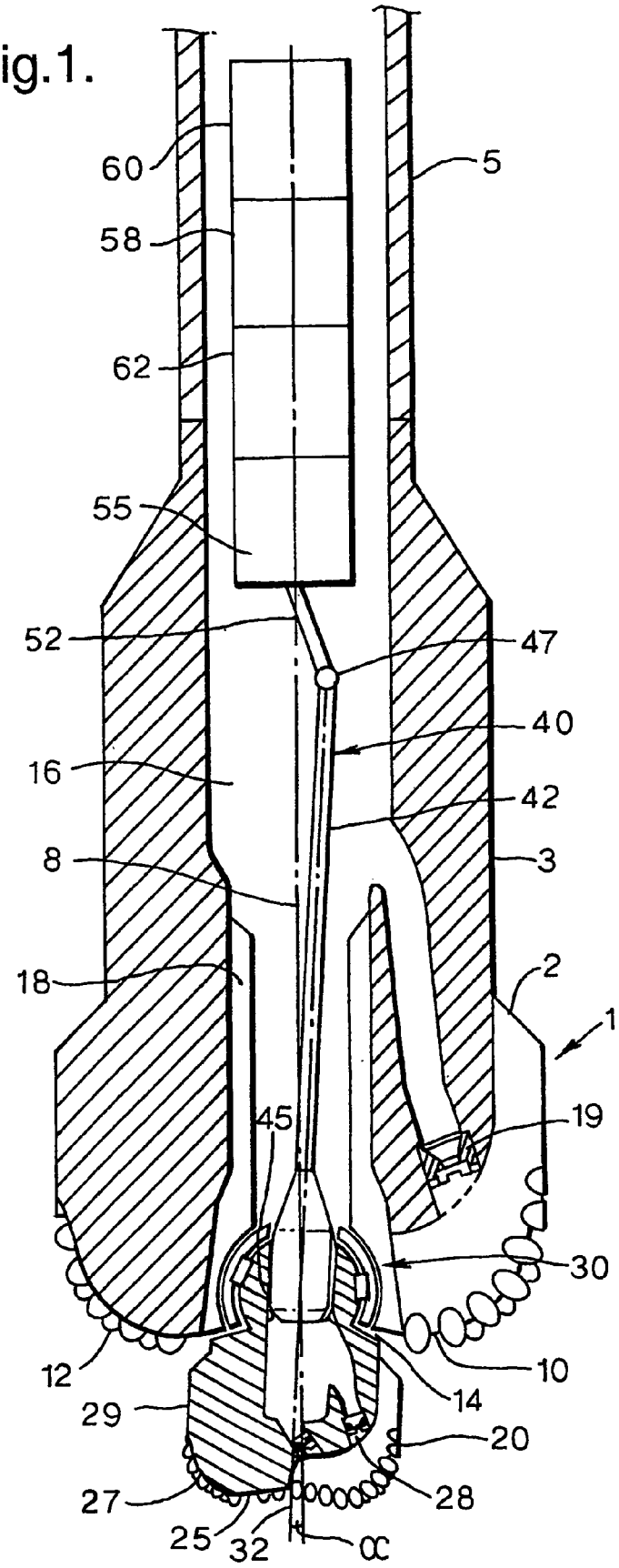

DETAILED DESCRIPTION OF THE PREFERRED EMBODIMENT.

The invention will now be described in more detail with reference to FIG. 1.

FIG. 1 shows schematically an example of a rotary drill bit assembly 1 for directionally drilling a borehole into an underground formation, according to the present invention. The drill bit assembly 1 comprises a drill bit 2 having a drill bit body 3, which is fixedly connected to the lower end of a tubular drill string 5. The bit body 3 extends from the drill string 5 along a central longitudinal bit-body axis 8 and has a bit-body face 10 at its front end. The bit-body face 10 is provided with chip-making elements in the form of polycrystalline diamond cutters 12, which are arranged around a central opening 14 in the bit-body face 10 and thereby forming an annular portion of the bit-body face 10. The cutters are suitably designed to give ease of side cutting.

The bit body 3 is provided with a central longitudinal passageway 16 providing fluid communication between the interior of the drill string 5 and the opening 14 of the bit body 3. The passageway 16 at the side of the opening 14 is provided with a sleeve 18, which is connected to the bit body 3. Further, fluid nozzles 19 are provided, which are in fluid communication with the passageway 16.

The drill bit 2 further comprises a pilot bit 20, which is partly arranged within the bit body 3 and projects out of the central portion 14 of the bit-body face 10. At its front end the pilot bit 20 has a pilot-bit face 25, which is provided with chip-making elements in the form of polycrystalline diamond cutters 27. The pilot bit is also provided with fluid nozzles 28, which are in fluid communication with the passageway 16. The pilot bit 20 further has a gauge side 29.

The pilot bit 20 is connected to the bit body 3 through a spherical joint means arranged at the front end of the sleeve 18, and shown schematically at reference numeral 30. The spherical joint means 30 allows pivoting of the pilot bit 20 with respect to the bit body 3, so that the central longitudinal pilot-bit axis 32 and the bit-body axis 8 can form a non-zero diversion angle. In the FIGURE the pilot bit is pivoted about an axis (not shown) perpendicular to the paper plane, and the diversion angle is indicated by the symbol a. The spherical joint means 30 also allows rotation of the pilot bit 20 about the bit-body axis 8 while the pilot-bit axis is pivoted by a non-zero diversion angle.

The spherical joint means 30 further is arranged so as to torque-lock the pilot bit 20 to the bit body 3, so that one revolution of the bit body 3 about the bit-body axis 8 results in one revolution of the pilot bit 20 about the pilot-bit axis 32.

The spherical joint means can suitably be designed based on a joint known in the art as universal joint. Well-known types of universal joints are for example Hooke, Bendix-Weiss, Rzeppa, Tracta, or double Cardan joints. The advantage of the universal joint is that no separate driving source and drill string for the pilot bit is needed, and that the pilot bit and the bit body rotate jointly with the same average angular velocity so that abrasive forces at the joint means can be kept to a minimum.

The drill bit assembly 1 further comprises a steering means for steering the drill bit 2, which steering means is generally referred to by reference numeral 40. The steering means 40 is arranged to pivot the pilot bit 20 in order to steer the drill bit 2. To this end, the steering means comprises a steering lever 42 extending from a contact arrangement 45 with the joint means 30 to a lever point 47 in the passageway 16 of the bit body 3. The contact arrangement 45 and the lever point 47 are located along the pilot-bit axis 32. The contact means 45 has the form of a bearing (not shown), which allows rotation of the pilot bit 20 about the pilot-bit axis 32 relative to the steering lever 42. By moving the lever point 47 the pilot bit can be pivoted, and due to the contact means in form of a bearing the orientation of the pilot bit can be steered independently of the rotation of the pilot bit.

In order that the pilot bit 20 can drill into a certain direction, the steering lever 42 needs to be oriented, and the lever point 47 is suitably set to remain geostationary during rotation of the bit body 3. Positioning is done using a positioning lever 52 of the steering means, which positioning lever 52 is connected at one end to the lever point 47. For compensating the rotation of the bit body 3 a rotation means in the form of step motor 55 is provided, which is connected to the other end of the positioning lever 52. The housing of the step motor 55 is arranged in a fixed orientation with the drill string 5 and the bit body 3. The lever point 47 can be kept at a geostationary location by rotating the positioning lever 52 relative to the bit body 3 about the bit-body axis 8, in opposite direction and with the same angular velocity as the rotating bit body 3, and while keeping the offset of the lever point 47 from the bit-body axis 8 constant.

The steering means further comprises a directional sensor package 58 for measuring data to determine the actual drilling trajectory of the drill bit; a surface communications package 60 including a mud pulser; and a steering control package 62 for controlling the positioning and rotation of the steering lever 42 in response to data from the directional sensor package 60, to data about the angular velocity of the drill string, and/or to commands received from the surface.

The sleeve 18 with the spherical joint means 30 and the attached pilot bit 20 forms a closure element for the passageway 16. As shown in FIG. 1 this closure element prevents access from the interior of the drill string 5 to the exterior of the bit body in the borehole via opening 14. The sleeve 18 can be removably attached to the bit body 3, for example by a latching mechanism (not shown), which is arranged so that the closure element can be selectively connected to and disconnected from the bit body. When the closure element has been removed, the exterior of the bit body in the borehole can be accessed from inside the drill string through the opening 14.

Normal operation of the embodiment shown in FIG. 1 will now be discussed. If a straight wellbore is to be drilled, the pilot-bit axis 32 is aligned with the bit-body axis 8, and to this end the lever point 47 is moved to a location on the bit-body axis 8. By putting drilling torque and weight on the drill bit 2, the pilot bit and bit body rotate jointly due to the torque lock of the spherical joint 30, and the drill bit will perform like a conventional drill bit of similar overall geometry. In particular there is no need in this situation to rotate the steering lever 42 by the step motor 55 relative to the bit body 3.

If then a curved wellbore is to be drilled, the pilot-bit axis 32 is set to deviate from the bit-body axis 8 by positioning the lever point 47 away from the bit-body axis. To this end, the steering control package appropriately steers the positioning lever 52, so that the steering lever 42 has the desired orientation in space (diversion angle and azimuthal orientation). The diversion angle between bit-body axis and pilot-bit axis can for example be set between 1 and 5 degrees, but larger or smaller values are also possible.

Drilling torque is provided to the bit body 3 and via the spherical joint means 30 at the same time to the pilot bit 20, so that the pilot bit progresses into the formation as guided by steering lever. The step motor 55 is activated to counteract the rotation of the bit body by rotating the positioning lever 52, so that the steering lever 42 remains substantially geostationary during at least one rotation of the bit body 3. The pilot bit 20 forms a pilot borehole section that deviates from the bit-body axis 8, and the bit body 3 is consequently levered towards the direction of the pilot borehole section by a guiding force exerted by the pilot bit via the joint means. The gauge side 29 of the pilot bit 20, which is subjected to abrasive forces from contact with the formation in the pilot borehole section, is suitably designed to minimize abrasion. The gauge side 29 can for example be manufactured from diamond or can include PDC gauge protection elements.

The actual overall direction of drilling is monitored by the directional sensor package 58. Data obtained from the directional sensor package and/or commands received from the surface via the surface communications package 60 are processed by the steering control package 62. The steering control package then controls the steering lever to match the desired and actual drilling trajectories.

The direction of drilling can be controlled by varying the orientation of the pilot bit (steering lever) in space (magnitude of the diversion angle and azimuthal orientation), suitably on a time scale longer than one revolution of the bit body. The steering means can be arranged to set the magnitude steplessly, or to switch between a predetermined non-zero diversion angle and zero diversion angle. The predetermined diversion angle can be a maximum diversion angle of the joint means.

While the illustrative embodiments of the invention have been described with particularity, it will be understood that various other modifications will be readily apparent to, and can be easily made by one skilled in the art without departing from the spirit of the invention. Accordingly, it is not intended that the scope of the following claims be limited to the examples and descriptions set forth herein but rather that the claims be construed as encompassing all features which would be treated as equivalents thereof by those skilled in the art to which this invention pertains.

We claim:

1. A rotary drill bit assembly suitable for directionally drilling a borehole into an underground formation, the drill bit assembly comprising:

a bit body extending along a central longitudinal bit-body axis, the bit body having a bit-body face at its front end and being attachable to a drill string at its opposite end, wherein an annular portion of the bit-body face is provided with one or more chip-making elements;

a pilot bit extending along a central longitudinal pilot-bit axis, the pilot bit being partly arranged within the bit body and projecting out of the central portion of the bit-body face, the pilot bit having a pilot-bit face at its front end provided with one or more chip-making elements;

a joint means arranged to pivotably connect the pilot bit to the bit body so that the bit-body axis and the pilot-bit axis can form a variable diversion angle; and a steering means arranged to pivot the pilot bit in order to steer, during normal operation, the direction of drilling.

2. The rotary drill bit assembly according to claim 1, wherein the joint means is a spherical joint means.

3. The rotary drill bit assembly according to claim 1, wherein the joint means is further arranged to torque-lock the pilot bit to the bit body.

4. The rotary drill bit assembly according to claim 1, wherein the steering means, for drilling at a constant non-zero diversion angle, is arranged so as to pivot the pilot bit with respect to the bit body such that the orientation of the pilot-bit axis in space remains substantially constant during at least one revolution of the bit body about the bit-body axis.

5. The rotary drill bit assembly according to claim 4, wherein the steering means comprises a steering lever extending substantially along the pilot-bit axis from a contact arrangement with the joint means to a lever point within the interior of the bit body, and wherein the pilot bit can be pivoted by changing the position of the lever point with respect to the bit body.

6. The rotary drill bit assembly according to claim 5, wherein the steering means further comprises a rotation means connected to the bit body, and wherein the lever point is set to remain substantially at its point in space by the rotation means which is arranged to rotate the lever point relative to the bit body about the bit-body axis, at constant offset from the bit-body axis, in opposite direction and with the same angular velocity as the rotating bit body.

7. The rotary drill bit assembly according to claim 5, wherein the contact arrangement with the joint means comprises a bearing arranged to allow rotation of the joint means about the pilot-bit axis relative to the steering lever.

8. The rotary drill bit assembly according to claim 1, wherein the steering means further comprises a steering control means arranged to control the direction of the steering lever during normal operation.

9. The rotary dill bit assembly according claim 8, wherein the steering control means comprises one or more of: a directional sensor package, a surface communications package, a rotation means for rotating the lever point about the bit-body axis.

10. The rotary drill bit assembly according to claim 1, wherein the bit body is provided with a passageway providing fluid communication between the interior of an attached drill string and the well bore exterior of the bit body, and with a removable closure element arranged to selectively close the passageway, wherein the closure element comprises the pilot drill bit.

11. A rotary drill bit suitable for directionally drilling a borehole into an underground formation, the drill bit comprising a bit body extending along a central longitudinal bit-body axis, the bit body having a bit-body face at its front end and being attachable to a drill string at its opposite end, wherein an annular portion of the bit-body face is provided with one or more chip-making elements;

a pilot bit extending along a central longitudinal pilot-bit axis, the pilot bit being partly arranged within the bit body and projecting out of the central portion of the bit-body face, the pilot bit having a pilot-bit face at its front end provided with one or more chip-making elements; and a joint means arranged to pivotably connect the pilot bit to the bit body so that the bit-body axis and the pilot-bit axis can form a variable diversion angle.

12. The rotary drill bit according to claim 11, wherein the joint means is a spherical joint means.

13. The rotary drill bit according to claim 11, wherein the joint means is further arranged to torque-lock the pilot bit to the bit body.

14. The rotary drill bit according to claim 11, wherein the bit body is provided with a passageway providing fluid communication between the interior of an attached drill string and the well bore exterior of the bit body, and with a removable closure element arranged to selectively close the passageway, wherein the closure element comprises the pilot drill bit.

15. A method for directional drilling of a borehole into an underground earth formation, comprising the steps of providing a rotary drill bit attached to the lower end of a drill string, the rotary drill bit comprising a bit body extending along a bit-body axis coaxial with the lower part of the drill string, and having a bit-body face at its front end, wherein an annular portion of the bit-body face is provided with one or more chip-making elements, and a pilot bit extending along a pilot-bit axis and projecting out of the central portion of the bit-body face, the pilot bit having a pilot-bit face at its front end provided with one or more chip-making elements; which pilot bit is pivotably arranged with respect to the bit body so that the bit-body axis and the pilot-bit axis can form a certain diversion angle;

setting the pilot bit along the pilot-bit axis at a selected variable diversion angle with respect to the bit-body axis;

providing at the same time drilling torque around the pilot-bit axis to the pilot bit and drilling torque around the bit-body axis to the bit body, and wherein the orientation of the pilot-bit axis in space is kept substantially constant during at least one revolution of the bit body about the bit-body axis.

16. The method according to claim 15, wherein the pilot bit and bit body are torque-locked.

17. The method according to claim 15, wherein the diversion angle is steplessly varied, in order to drill into along a certain trajectory.

18. The method according to claim 15, wherein the diversion angle is varied by switching between zero and a predetermined non-zero diversion angle, in order to drill along a certain trajectory.

* * * * *